US008038185B2

(12) United States Patent
Wood

(10) Patent No.: US 8,038,185 B2
(45) Date of Patent: Oct. 18, 2011

(54) LOCKING DEVICE

(75) Inventor: Brian Wood, Byron, MI (US)

(73) Assignee: Magna Closures Inc, Newmarket, Ontario (CA)

( * ) Notice: Subject to any disclaimer, the term of this patent is extended or adjusted under 35 U.S.C. 154(b) by 406 days.

(21) Appl. No.: 11/497,164

(22) Filed: Aug. 1, 2006

(65) Prior Publication Data

US 2007/0024068 A1 Feb. 1, 2007

Related U.S. Application Data

(60) Provisional application No. 60/704,400, filed on Aug. 1, 2005.

(51) Int. Cl.
*E05B 3/00* (2006.01)
*E05B 65/10* (2006.01)

(52) U.S. Cl. ..... 292/336.3; 292/DIG. 22; 292/DIG. 65

(58) Field of Classification Search ..... 292/336.3, 292/DIG. 65, DIG. 22
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 3,799,596 | A * | 3/1974 | Nozomu et al. | 292/216 |
| 5,584,516 | A | 12/1996 | Cetnar | |
| 5,669,642 | A | 9/1997 | Kang | |
| 6,007,122 | A * | 12/1999 | Linder et al. | 292/336.3 |
| 6,042,159 | A * | 3/2000 | Spitzley et al. | 292/216 |
| 6,070,923 | A | 6/2000 | Tanimoto et al. | |
| 6,575,508 | B2 | 6/2003 | Stuart et al. | |
| 6,709,033 | B2 * | 3/2004 | Jooss et al. | 292/336.3 |
| 6,719,336 | B2 * | 4/2004 | Sato | 292/336.3 |
| 6,749,236 | B2 * | 6/2004 | Nomura et al. | 292/336.3 |
| 6,880,867 | B2 | 4/2005 | Schoen et al. | |
| 7,029,042 | B2 * | 4/2006 | Belchine, III | 292/336.3 |
| 7,070,216 | B2 * | 7/2006 | von zur Muehlen | 292/336.3 |
| 7,303,217 | B2 * | 12/2007 | Savant | 292/336.3 |
| 2005/0012345 | A1 * | 1/2005 | Saitoh | 292/336.3 |

* cited by examiner

*Primary Examiner* — Carlos Lugo
(74) *Attorney, Agent, or Firm* — Miller Canfield

(57) ABSTRACT

A locking device is provided for preventing an outside door handle assembly, having a handle, a stem extending out from the handle, and a counterweight operably connected between the handle and a release rod, from activating the release rod in response to a motor vehicle impact. The locking device includes a catch fixedly secured to the counterweight and engageable with the stem in response to the motor vehicle impact in order to prevent the handle from activating the release rod.

3 Claims, 3 Drawing Sheets

LOCKING DEVICE

RELATED APPLICATION

This application claims all the benefits and priority to U.S. Provisional Application No. 60/704,400 filed on Aug. 1, 2005.

FIELD OF THE INVENTION

The invention relates to a door latch for a motor vehicle. More particularly, the invention relates to a locking device for preventing release of a door latch during a motor vehicle impact.

DESCRIPTION OF RELATED ART

In a motor vehicle impact, in particular a side impact, a door latch of the motor vehicle may inadvertently release, which results in the opening of a motor vehicle door. The opening of the door in such circumstances is undesirable. Thus, there remains a need for a simple locking device that prevents a door latch from releasing during a motor vehicle impact.

SUMMARY OF THE INVENTION

According to one aspect of the invention, a locking device is provided for preventing an outside door handle assembly, having a handle, a stem extending out from the handle, and a counterweight operably connected between the handle and a release rod, from activating the release rod in response to a motor vehicle impact. The locking device includes a catch fixedly secured to the counterweight and engageable with the stem in response to the motor vehicle impact in order to prevent the handle from activating the release rod.

According to another aspect of the invention, a locking device is provided for preventing inadvertent release of a latch release lever of a door latch mechanism during a motor vehicle impact. The locking device includes a collapsible bracket fixedly secured to the door latch mechanism at a location adjacent the latch release lever. The collapsible bracket is foldable into engagement with the latch release lever in response to the motor vehicle impact in order to prevent the latch release lever from releasing the door latch mechanism.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
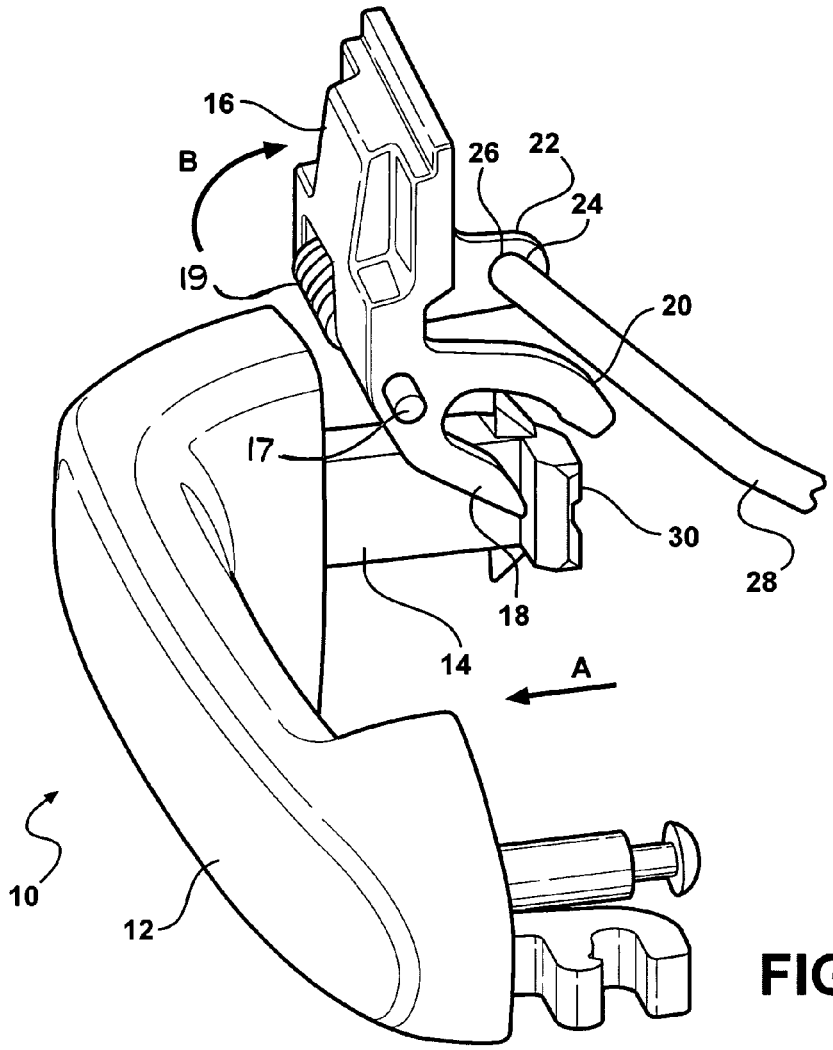
FIG. 1 is a perspective view of an outside door handle assembly including a locking device according to one embodiment of the invention.

Referring to FIG. 1, an outside door handle assembly, generally shown at 10, for a motor vehicle door is operatively connected to a door latch mechanism. The outside door handle assembly 10 includes a handle 12 and a stem 14 extending out from the handle 12. A counterweight 16 is rotatably mounted on a pivot rod 17 along a base (not shown) of the outside door handle assembly 10. The counterweight 16 includes a leg 18 abutting a distal end projection 30 on the stem 14 and a locking device 20 spaced apart from the leg 18 and located on the opposing side of the projection 30 such that the projection 30 is straddled by the legs 18, 20. A biasing member 19, or coil spring, is coupled between the counterweight 16 and the pivot rod 17 for biasing the counterweight 16 in the counterclockwise direction shown in FIG. 1. In the current embodiment, the locking device 20 is a catch or second leg. The counterweight 16 also includes a protrusion 22 having an aperture 24 for receiving one end 26 of a release rod 28.

During normal operation, when a user pulls the handle 12, the stem 14 moves axially in the direction of arrow A. As a result, the stem 14 pushes against the leg 18 to initiate rotational movement of the counterweight 16 in the direction of arrow B, thereby pushing the release rod 28 downwards for releasing the door latch mechanism. In such normal operation of the outside door handle assembly 10, the catch 20 simply rotates around one end 30 of the stem 14 as the stem 14 urges rotational movement of the counterweight 16. More specifically, the catch 20 has a specific configuration or curvature that allows the axial movement of the handle 12 to proceed unimpeded. It is appreciated that the particular configuration or curvature of the catch 20 may vary.

However, during a motor vehicle impact, the catch 20 lockingly or abuttingly engages the end 30 of the stem 14 to prevent axial movement thereof in the direction of arrow A. As a result, the counterweight 16 cannot be urged into rotation by the stem 14, which in turn prevents the release rod 28 from moving downwards to release the door latch mechanism. More specifically, during a motor vehicle impact, inertia urges the counterweight 16 to rotate clockwise about the pivot rod 17 against the biasing force of the spring 19. However, such rotation of the counterweight 16 causes the locking device 20, or leg, to abut the projection 30 on the distal end of the stem 14 and prevents further rotation of the counterweight 16. Without actuation of the handle 12 to move the stem 14, the counterweight 16 is prevented from further rotation and thus unable to actuate the release rod 28 to release the door latch mechanism.

Figure 2:
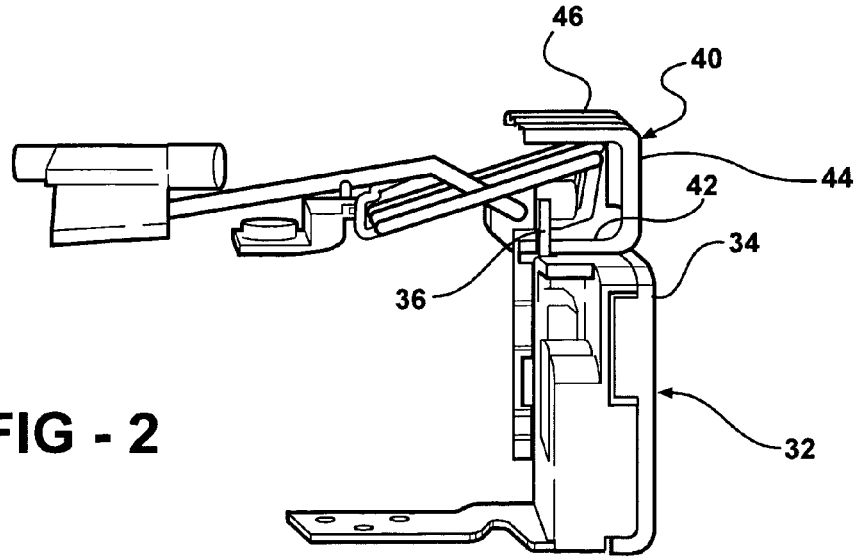
FIG. 2 is a perspective view of a locking device or collapsible bracket according to another embodiment of the invention.
Figure 1A:
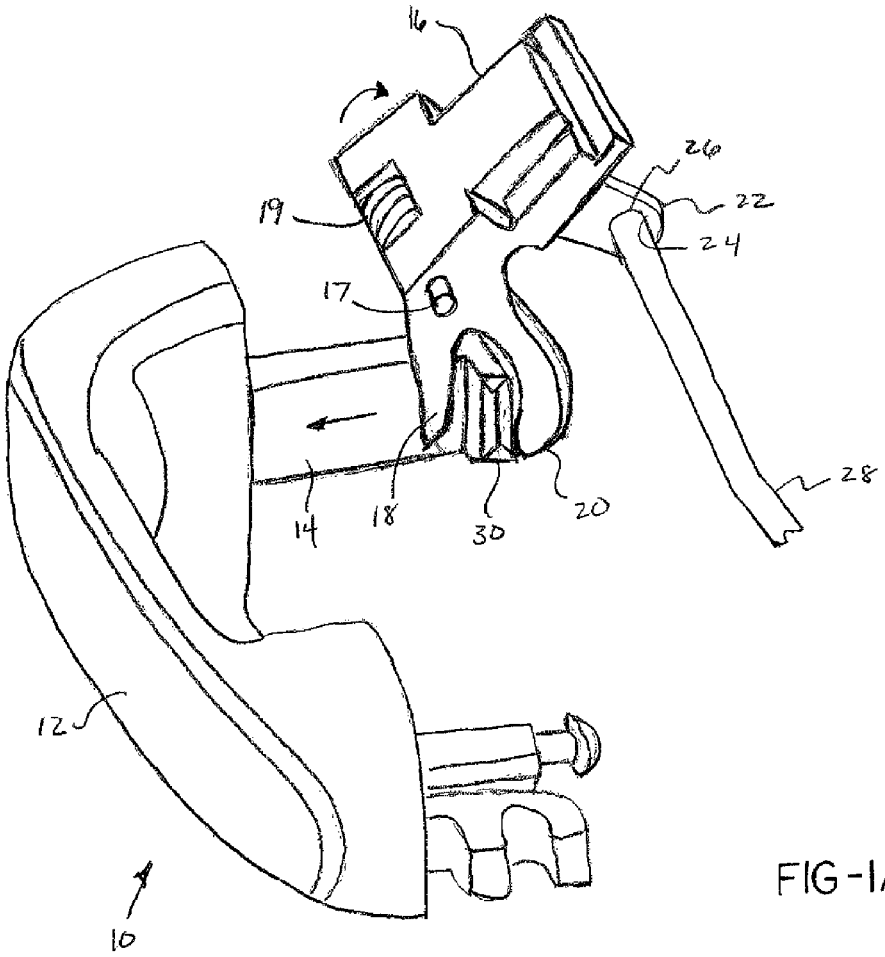
FIG. 1A is a perspective view of the door handle assembly with the locking device in a blocking position during a motor vehicle impact.
Figure 3:
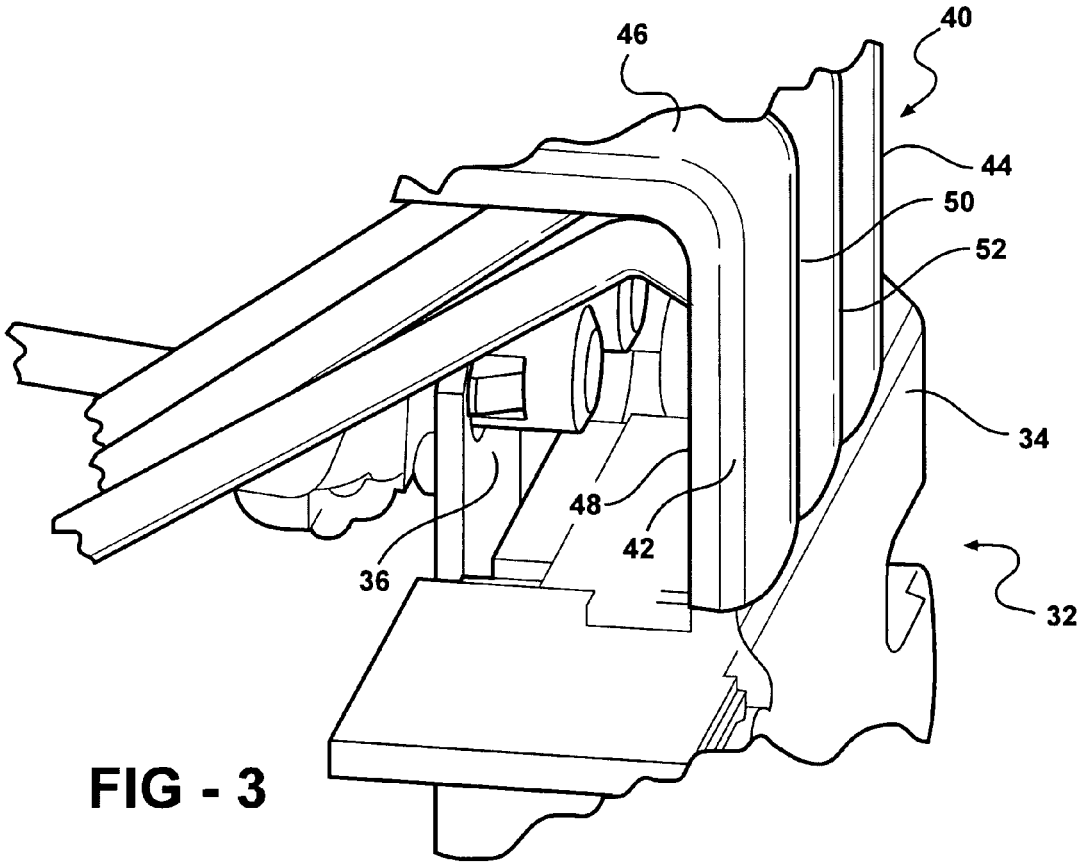
FIG. 3 is a fragmentary, perspective view of the collapsible bracket mounted along a metal plate of a door latch mechanism.
Figure 4:
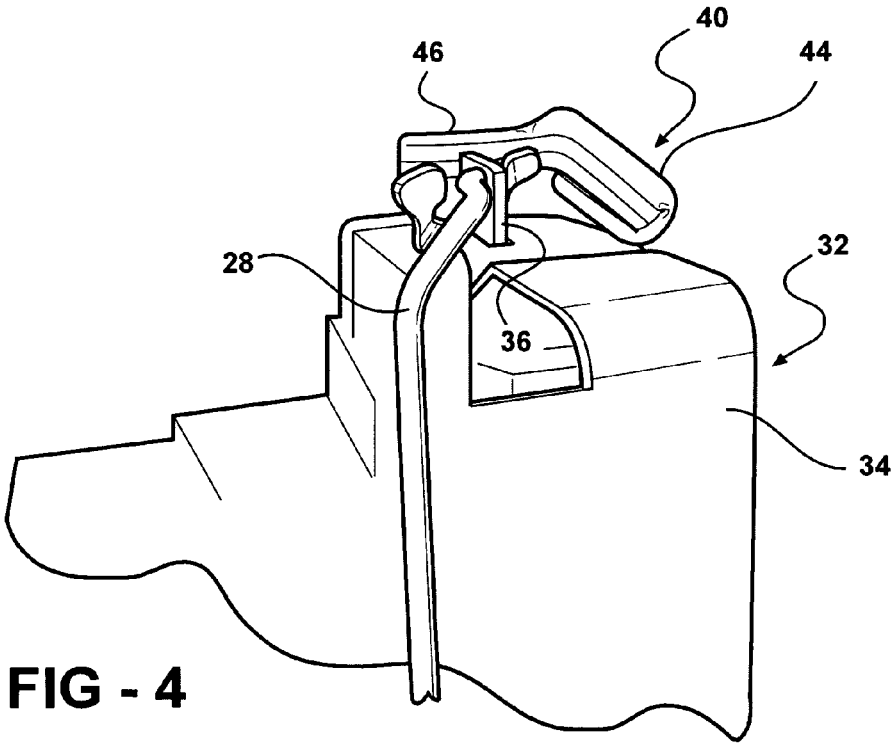
FIG. 4 is a perspective view of the collapsible bracket including first and second walls folded over a latch release lever of the door latch mechanism.

Referring to FIGS. 2-4, according to another embodiment of the invention, a door latch mechanism, generally indicated at 32, includes a metal plate 34 for housing and protecting a ratchet and pawl from outside interference. The door latch mechanism 32 also includes a latch release lever 36 that is coupled to one end of the release rod 28, best shown in FIG. 4. Actuation of the release rod 28 causes the latch release lever 36 to disengage from the pawl, which in turn releases the door latch mechanism 32.

A locking device or collapsible bracket, generally indicated at 40, is fixedly secured to the metal plate 34. More specifically, the collapsible bracket 40 is positioned along the metal plate 34 so as to cover the end of the latch release lever 36 coupled to the release rod 28. The collapsible bracket 40, which is preferably a stamped metal component, includes a flange 42 secured to the metal plate 34. Preferably, the flange 42 is secured to the metal plate 34 using a structural adhesive. It is, however, appreciated that the flange 42 may be mounted along the metal plate 34 in any of numerous ways.

The collapsible bracket 40 includes a first wall 44 extending out from the flange 42, and a second wall 46 extending out perpendicularly from the first wall 44. The first wall 44 includes indentations 48 along each side adjacent the flange 42. A pair of elongated recesses 50, 52 are formed along the collapsible bracket 40 and extend along each of the first 44 and second 46 walls. The indentations 48 and elongated recesses 50, 52 facilitate crumpling of the collapsible bracket 40.

During a motor vehicle impact, in particular a side impact, the collapsible bracket 40 folds over the latch release lever 36, as shown in FIG. 4. More specifically, each of the first 44 and second 46 walls collapse against the latch release lever 36 and fix the latch release lever 36 in place. Thus, the latch release lever 36 is not able to move into a release position for disengaging the pawl from the ratchet. As a result, the door is not able to open.

Finally, it should be appreciated that although the collapsible bracket 40 has been described as having collapsing first 44 and second 46 walls, the particular configuration of the collapsible bracket 40 may vary so long as the collapsible bracket 40 protects the latch release lever 36 by fixing the latch release lever 36 in place during a motor vehicle impact.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

What is claimed:

1. A locking device for preventing inadvertent unlatching of a door latch mechanism of a motor vehicle door in response to an external force by a motor vehicle impact, said locking device comprising:

a door handle assembly having a handle and a stem extending out from said handle to a distal end and said door handle assembly movable in an axial direction, said stem including a projection on the distal end thereof having a front side and an opposite back side defining said distal end;

a release rod adapted to be connected to the door latch mechanism for selectively unlatching the door latch mechanism in response to axial movement of said door handle assembly; and a counterweight pivotally mounted to said door handle assembly and operatively coupled between said stem and said release rod for activating the release rod in response to axial movement of said door handle assembly, said counterweight including spaced first and second legs;

wherein during a normal operation of the door handle assembly, axial movement of the door handle assembly will make the projection of the stem to engage the first leg to rotate said counterweight and activate said release rod thereby selectively unlatching the door latch mechanism, said second leg will not interfere in the movement;

wherein during the motor vehicle impact, the external force will make the counterweight to rotate, making the second leg to engage the projection of the stem to move the projection between the first and second legs, blocking further rotational movement of the counterweight thereby preventing incidental movement and activation of the release rod and unlatching of the door latch mechanism.

2. The locking device as set forth in claim 1, wherein said counterweight is pivotally supported by a pivot rod for rotation thereabout in response to axial movement of the door handle assembly to activate the release rod.

3. The locking device as set forth in claim 2, further including a biasing member coupled between said counterweight and said pivot rod for biasing said first leg of said counterweight against said projection on said stem.

* * * * *